US006892951B2

(12) United States Patent
Goldenberg et al.

(10) Patent No.: US 6,892,951 B2
(45) Date of Patent: May 17, 2005

(54) WALLET ACCESSORY WITH PHOTOGRAPH SLEEVES AND DIGITAL PLAYBACK DEVICE

(75) Inventors: Larry Goldenberg, 327 Central Park W., #9E, New York, NY (US) 10025; Thomas Barham, Stamford, CT (US)

(73) Assignee: Larry Goldenberg, New York, NY (US)

( * ) Notice: Subject to any disclaimer, the term of this patent is extended or adjusted under 35 U.S.C. 154(b) by 0 days.

(21) Appl. No.: 10/420,647

(22) Filed: Apr. 22, 2003

(65) Prior Publication Data

US 2004/0211842 A1 Oct. 28, 2004

(51) Int. Cl.[7] ..... G06K 19/06
(52) U.S. Cl. ..... 235/492
(58) Field of Search ..... 235/492; 360/137; 150/139; 704/272; 40/717

(56) References Cited

U.S. PATENT DOCUMENTS

| | | | | | |
|---|---|---|---|---|---|
| 4,105,057 | A | | 8/1978 | Baumann et al. | 150/35 |
| 4,904,853 | A | * | 2/1990 | Yokokawa | 235/487 |
| 4,942,913 | A | | 7/1990 | Musso | 150/138 |
| 5,221,838 | A | * | 6/1993 | Gutman et al. | 235/379 |
| 5,418,520 | A | * | 5/1995 | Hirshberg | 340/568.7 |
| 5,431,207 | A | | 7/1995 | Siegel | 150/139 |
| 5,504,836 | A | | 4/1996 | Loudermilk | 395/2.81 |
| 5,634,080 | A | * | 5/1997 | Kikinis et al. | 710/73 |
| 5,662,217 | A | * | 9/1997 | Durr | 206/308.1 |
| 5,775,398 | A | | 7/1998 | Siegel | 150/139 |
| 5,956,682 | A | | 9/1999 | Loudermilk et al. | 704/272 |
| 6,028,752 | A | | 2/2000 | Chomette et al. | 360/137 |
| 6,065,674 | A | * | 5/2000 | Shriver | 235/380 |
| 6,185,851 | B1 | | 2/2001 | Loudermilk et al. | 40/717 |
| 6,263,310 | B1 | | 7/2001 | Loudermilk et al. | 704/272 |
| 6,377,926 | B2 | | 4/2002 | Loudermilk | 704/272 |
| 6,381,573 | B1 | | 4/2002 | Loudermilk | 704/272 |
| 6,427,836 | B1 | * | 8/2002 | Bolanos | 206/449 |
| 6,680,715 | B2 | * | 1/2004 | Blotky et al. | 345/1.3 |

* cited by examiner

*Primary Examiner*—Karl D. Frech
*Assistant Examiner*—Lisa M. Caputo
(74) *Attorney, Agent, or Firm*—Gordon & Jacobson, PC

(57) ABSTRACT

A wallet accessory includes a plurality of photograph sleeves, a digital playback device, and a device sleeve for the playback device. The device sleeve includes an opening within a face of the sleeve for purpose of permitting sound to enter a microphone of the playback device and permitting sound from a speaker of the playback device to be transmitted out of the device sleeve. The device includes a plurality of playback buttons and a plurality of the photograph sleeves includes respective indicia which associates one of the sleeves with a respective one of the buttons. As such, a photograph of a person in one of the photograph sleeves can be associated with a recorded message by that person which is played back by pressing a corresponding first button on the playback device.

30 Claims, 3 Drawing Sheets

WALLET ACCESSORY WITH PHOTOGRAPH SLEEVES AND DIGITAL PLAYBACK DEVICE

BACKGROUND OF THE INVENTION

1. Field of the Invention

This invention relates broadly to wallet accessories. More particularly, this invention relates to wallet accessories incorporating multiple sleeves for storage and display.

2. State of the Art

Wallet accessories for use with pre-existing wallets are described in U.S. Pat. No. 4,105,057 and U.S. Pat. No. 4,942,913. These devices are typically destined for "after market" applications where a retailer who sells conventional wallets also offers special inserts for the wallets. The wallet accessory shown in U.S. Pat. No. 4,105,057 is designed to provide extra storage space for carrying additional credit cards. The accessory may also be used to provide a credit card holder for wallets which are not so equipped. Although it would be possible to place photographs within these accessories, in order to view the photograph, the photographs would have to be removed from the receptacle.

U.S. Pat. No. 4,942,913 shows a "sub-wallet" for use with a main wallet. The sub-wallet carries important items which the wallet owner always needs, while the remainder of the wallet carries items that are not absolutely necessary. If necessary, the owner can subsist on the sub-wallet alone, and does not require the contents of the main wallet. Although photographs could be placed in the wallet or the sub-wallet, it would not be possible to view more than one of these photos unless one were to remove them from the wallet or sub-wallet, thereby causing the photographs to become worn and mutilated over time.

Other types of wallets are described in U.S. Pat. Nos. 5,431,207 and 5,775,398. These patents disclose wallet accessories having compartmental arrangements for accommodating devices such as calculators, along with holders for accommodating various sundries. None of the wallets or known accessories therefor are specifically adapted for use with audio devices in conjunction with photographs.

SUMMARY OF THE INVENTION

It is therefore an object of the invention to provide a wallet accessory that is adapted to display photographs and to hold a portable digital playback device.

It is another object of the invention to provide a wallet accessory having a portable digital playback device that can store several files, e.g., audio and/or video messages, and reference each file to one of the several photographs stored in the accessory.

In accord with these objects, which will be discussed in detail below, a wallet accessory includes a plurality of photograph sleeves integrated with a dedicated sleeve for a digital playback device. In particular, the wallet accessory preferably comprises a panel having at one side the plurality of photograph sleeves coupled thereto, and at another side the dedicated sleeve for the playback device. The sleeve for the playback device preferably includes an opening within a face of the sleeve for permitting sound from a speaker of the device to be transmitted out of the dedicated sleeve.

The sleeves and the playback device are sized for placement within a wallet. To that end, an insert is coupled to a side of the panel and is adapted in size to be received in a pocket of the wallet to couple the panel, and thus the sleeves and the device to the wallet. In accord with one preferred embodiment of the invention, two inserts are coupled to the panel, one adapted for a horizontally-oriented wallet pocket and the other adapted for a vertically-oriented wallet pocket. The unnecessary insert is folded out of the way or removed.

According to a preferred aspect of the invention, the device preferably includes a plurality of buttons having individual indicia associated therewith, and a plurality of the photograph sleeves may be provided with indicia corresponding to the indicia associated with the buttons. As such, a photograph of a person in a photograph sleeve is associated with a recorded message by that person which is played back by pressing a corresponding button on the device.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
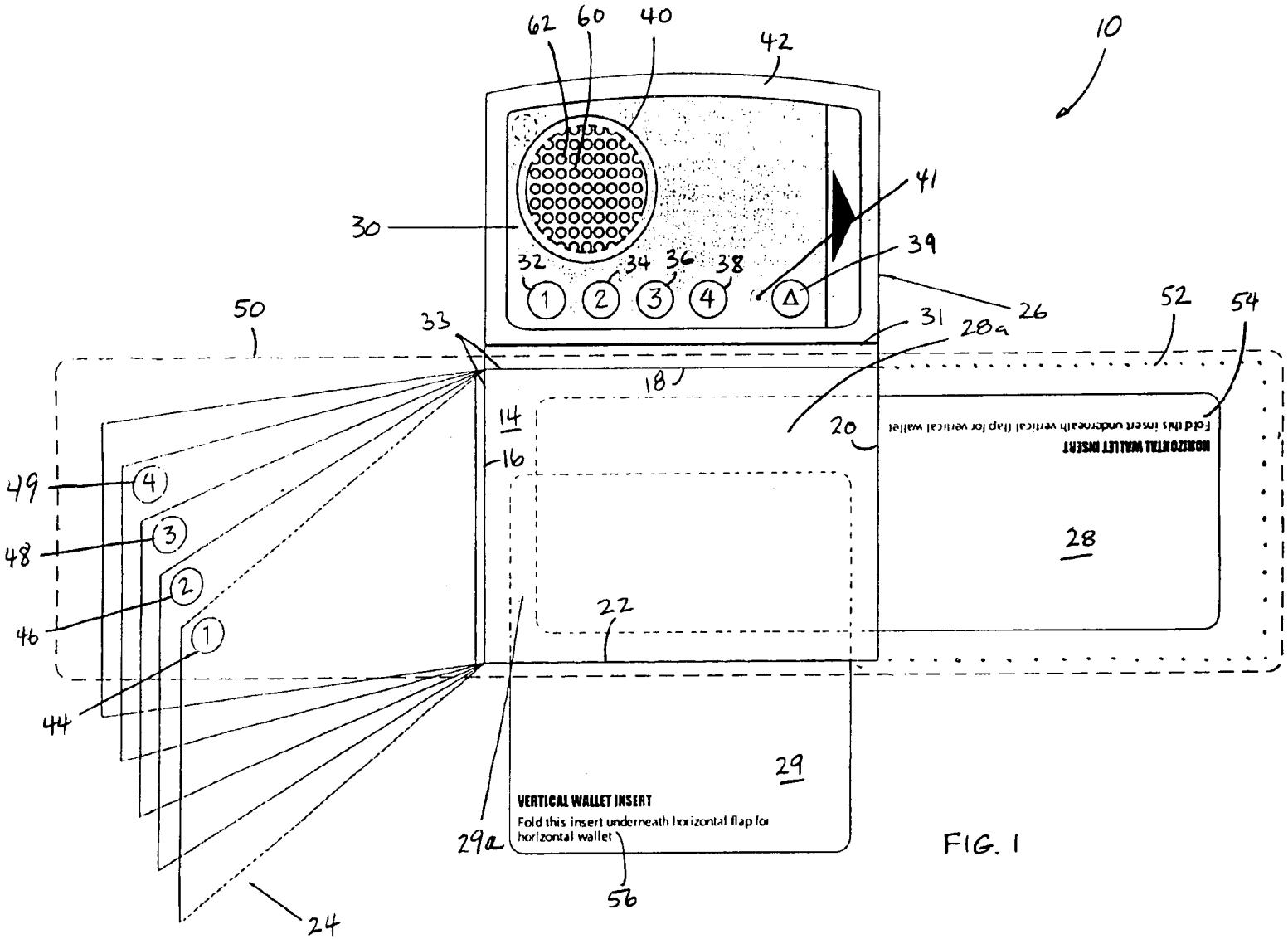
FIG. 1 is a schematic of a first embodiment of a wallet accessory according to the invention, including photograph sleeves and a digital playback device in another sleeve, with a wallet indicated by a set of broken lines.

Turning now to FIG. 1, a wallet accessory 10 is shown. The wallet accessory 10 includes a central panel 14 with sides 16, 18, 20, 22. The panel 14 may be a sleeve having a transparent front side so that a photograph may be placed within the panel and viewed by a user of the accessory. A plurality of photograph sleeves 24 are coupled to side 16 of the panel 14, a device sleeve 26 (for a digital audio device 30, described below) is coupled to side 18, and a first card-like insert 28 is coupled to side 20. A second insert 29 is preferably coupled to side 22 of the panel 14. Live hinges 33 or a flexible or bending material are preferably provided at the coupling of each of the elements to the panel 14. A digital playback device 30 is preferably removably retained within the device sleeve 26, although if desired, the device may be sealed in the sleeve 26 by a seal 31 (e.g., heat seal, bonding or stitching). The hinges 33 may be adapted in structure to permit limited movement of the photograph sleeves 24 and/or the device sleeve 26 relative to the panel 14 such that the sleeves 24, 26 when in a fully open configuration rest at an angle relative to the panel 14. Such angle may facilitate operation of the device 30 in sleeve 26 and viewing of photographs in sleeves 24.

The digital playback device 30 is generally the shape and size of a credit card (e.g., 2"×3"), although it may be slightly thicker (e.g., 3/32"–3/16"). The device 30 may include a power source (e.g., battery, not shown), a microphone 60 and an audio speaker 62, a memory for storing digital files such as recorded messages, buttons 32, 34, 36, 38 operating playback functions and button 39 operating record functions, and an LED indicator 41. A credit card size audio recording and playback device is described in U.S. Pat. No. 6,028,752 to Chomette, which is hereby incorporated by reference herein in its entirety. As one of several distinctions from the Chomette device, device 30 preferably includes a plurality of playback buttons 32, 34, 36, 38 each having different indicia associated therewith. For example, button 32 has a '1' thereon, button 34 has a '2' thereon, button 36 has a '3' thereon, and button 38 has '4' thereon. Other indicia are shown on buttons 32*a*, 34*a*, 36*a*, 38*a* in FIG. 2.

The device 30, by way of example, may be operated to record an audio message for storage in memory by pressing the record button 39 in conjunction with any one of the playback button 32, 34, 36, 38. During recording, the LED indicator 41 lights up, and sound, e.g. voice, is directed by the user toward the microphone 60. Recording is terminated and the message is saved upon release of the record button 39 or when the memory allocated for that message is full, whichever occurs first. Each message preferably may be up to sixty seconds in length. The recorded message may thereafter be played back by pressing the corresponding playback button only.

The device sleeve 26 for the device 30 preferably includes opening 40 within a face 42 of the sleeve 26 (coincident with the speaker 62 and microphone 60 of the device) for purpose of permitting sound to enter a microphone 60 of the device and permitting sound from a speaker 62 of the device 30 to be transmitted out of the device sleeve 26. The other portions of the device 30 remain protected by the device sleeve 26, and the device is retained (from inadvertent loss) within the accessory.

The photograph sleeves 24 are sized to receive wallet-size format photographs (e.g., approximately 1"×1.5" to 3"×4" size). The photograph sleeves 24 preferably include respective indicia 44, 46, 48, 49 which correspond to the indicia associated with respective ones of the buttons 32, 34, 36, 38. That is, the indicia on an associated button and sleeve need not be same, but should clearly indicate that a sleeve corresponds with a particular one of the buttons. As such, a photograph of a person in a first photograph sleeve 44 is associated with a recorded message by that person which is played back by pressing a corresponding first button 32 on the device. Likewise, each of the other photograph sleeves with indicia may hold a photograph of a person who recorded a message played back by pressing a corresponding button.

Alternatively, the indicia 44, 46, 48, 49 for the photograph sleeves 24 may be separately provided, e.g., as a sheet of stickers, and the user can apply the stickers to the respective sleeves, as desired.

Figure 2:
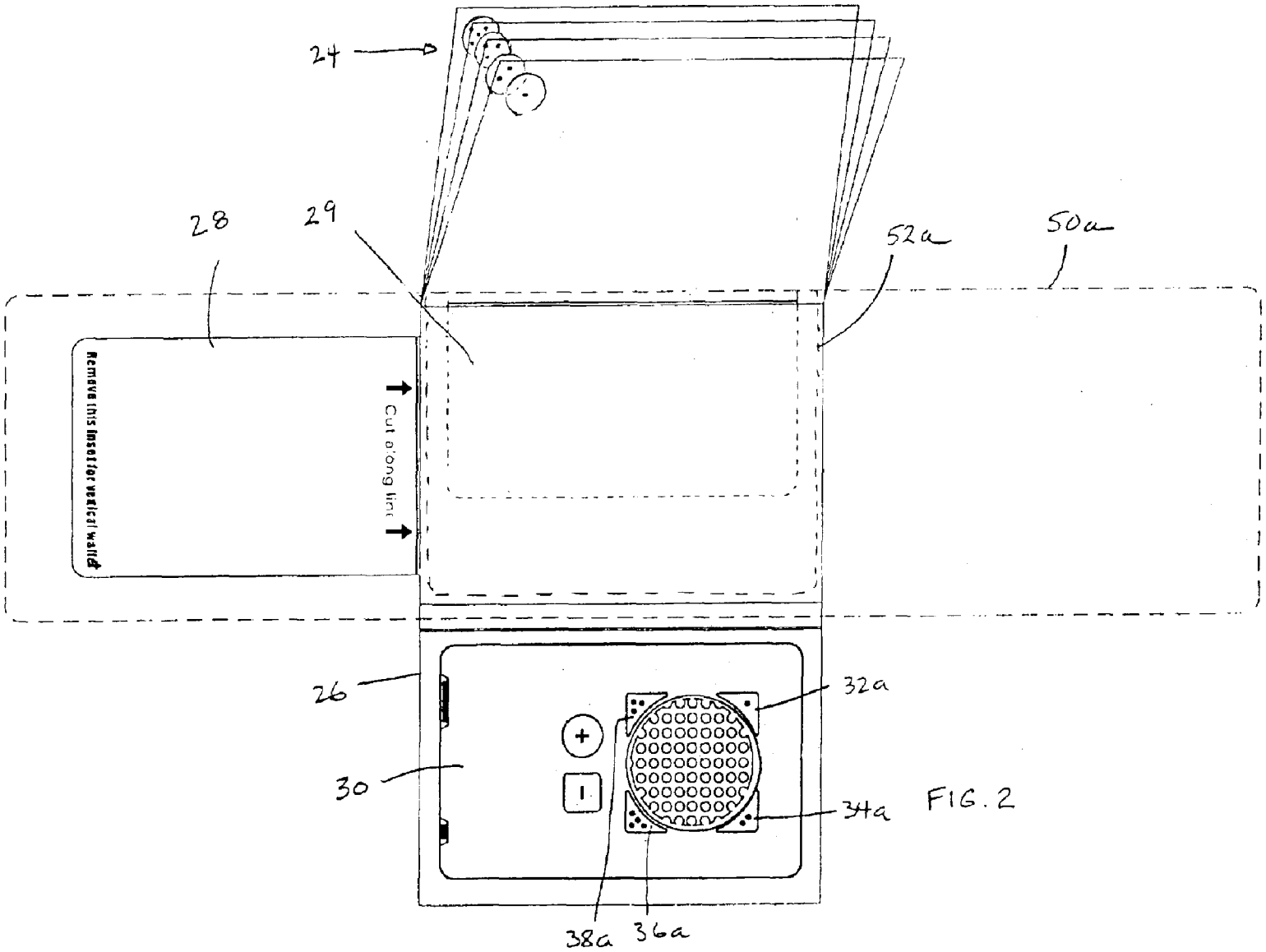
FIG. 2 is a schematic of a second embodiment of a wallet accessory according to the invention, with a wallet indicated by a set of broken lines.

The system 10 is sized for placement within a wallet 50. To that end, the first insert 28 is adapted in size and orientation to be longitudinally received in a lateral pocket 52 of a horizontal fold wallet. In addition, the second insert 29 is adapted in size and orientation to be transversely received in a vertical pocket of a vertical fold wallet. Depending on the type of wallet 50 with which the system 10 will be used, one of the first and second inserts 28, 29 will not be needed for coupling the insert 10 to the wallet. In FIG. 1, a wallet having a horizontal pocket 52 is shown, and thus the second insert 29 (adapted for a vertical pocket) is unnecessary. Referring to FIG. 2, a wallet 50*a* having a vertical pocket 52*a* is shown. The second insert 29 is folded back and inserted into the pocket 52*a*, and the first insert 28 is unnecessary. Referring back to FIG. 1, the unnecessary insert can be removed (cut or torn away) or folded behind out of the way, as indicated by 28*a* and 29*a* (broken lines), by the user prior to attaching the system 10 to the wallet 50. Instructions 54, 56 may be provided on the inserts 28, 29 indicating the removal or folding of the inserts based upon wallet type.

Figure 3:
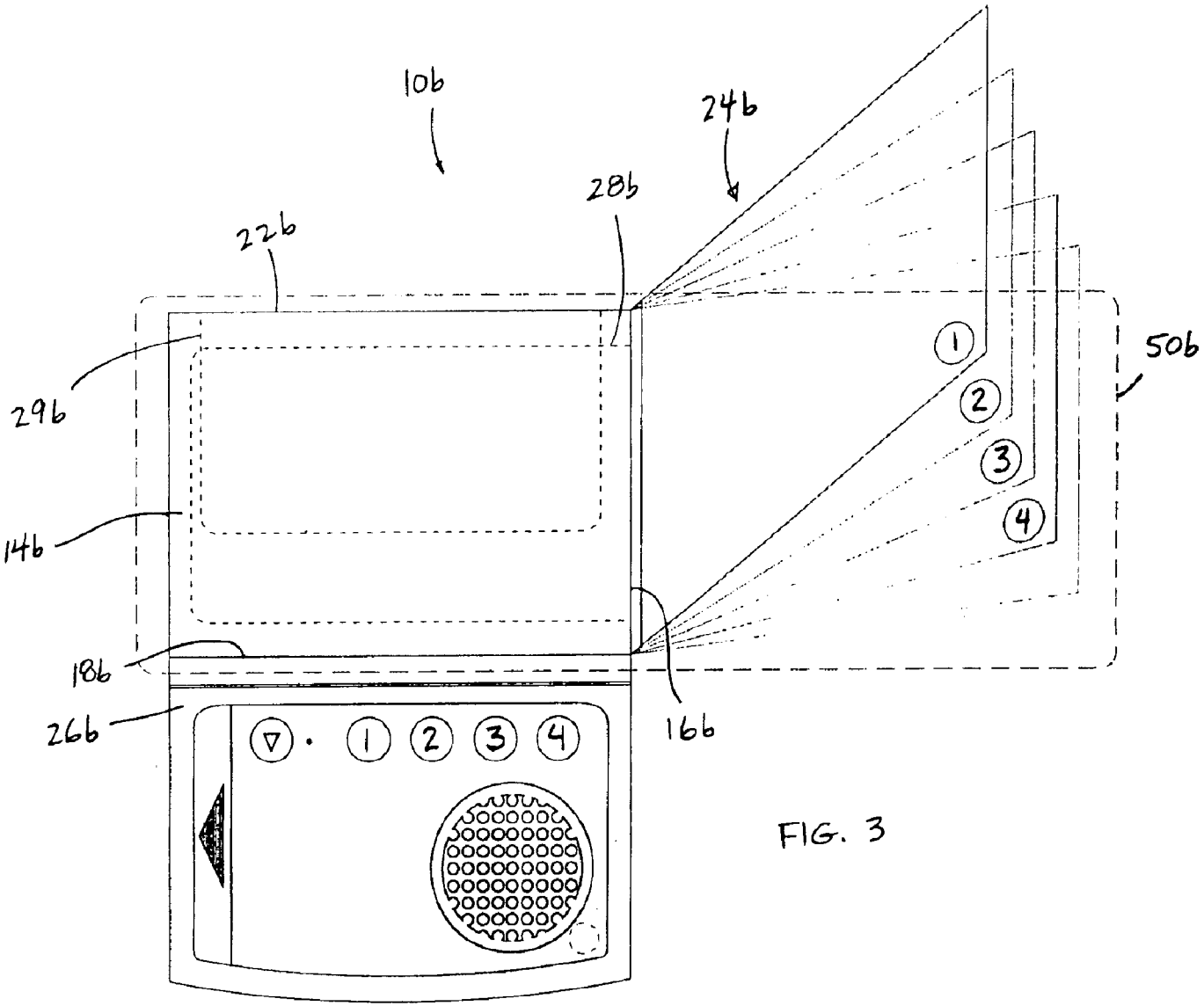
FIG. 3 is a schematic of a third embodiment of a wallet accessory according to the invention, with a wallet indicated by a set of broken lines.

Turning now to FIG. 3 another embodiment of the accessory 10*b* is shown. The accessory 10*b* includes a panel 14*b* having a plurality of photograph sleeves 24*b* coupled to side 16*b*, a horizontal insert 28*b* also coupled to side 16*b*, a device sleeve 26*b* coupled to side 18*b*, and a vertical insert 29*b* coupled to side 22*b*. The horizontal and vertical inserts 28*b*, 29*b* underlie the panel 14*b*. In FIG. 3, the horizontal insert 28*b* is shown longitudinally inserted into a pocket of bi-fold wallet 50*b*. When the accessory 10*b* is closed, the device sleeve 26*b* is folded over the panel 14*b* and the photograph sleeves 24*b* are folded over the device sleeve 26*b* such that every element of the accessory (the panel 14*b*, photograph sleeves 24*b*, device sleeve 26*b*, and horizontal and vertical inserts 28*b*, 29*b*) overlie (underlie) one another.

The photograph sleeves 24 and device sleeve 26 are preferably made from acrylic, polyvinyl or another transparent plastic and are preferably flexible so as to prevent cracking or other damage to the sleeves when the system 10 is placed within the wallet.

With the wallet accessory 10 of the invention, it will be appreciated that the user of the wallet will have the opportunity to look at pictures contained in a photograph sleeve 24 and listen to a voice recording associated with that photograph by manipulating the audio device 30 in the device sleeve 26.

There have been described and illustrated herein embodiments of a wallet accessory having a plurality of photograph sleeves and an audio playback device. While particular embodiments of the invention have been described, it is not intended that the invention be limited thereto, as it is intended that the invention be as broad in scope as the art will allow and that the specification be read likewise. Thus, while an audio device having recording and playback capabilities is described, the audio device might having playback capability only, and audio storage may be obtained from a download via a data port (not shown). In addition, the device may additionally or alternatively have video capability for playback of video files, where the video files are placed in device memory by a recording system of the device and/or via download. Also, while the wallet accessory was shown as having both horizontal and vertical inserts, it will be appreciated that only one insert is required. It will therefore be appreciated by those skilled in the art that yet other modifications could be made to the provided invention without deviating from its spirit and scope as claimed.

What is claimed is:

1. A wallet accessory system for a wallet having a pocket, comprising:

a) a first insert sized to be received in the pocket of the wallet to couple said accessory to the wallet;

b) a plurality of transparent sleeves coupled to said insert, said sleeves sized for receiving wallet-size format photographs;

c) a digital playback device having at least one memory capable of storing a plurality of digital files and at least one button adapted to initiate playback of a selected one of said files; and d) a device sleeve at least partially containing said playback device, said device sleeve coupled to said insert.

2. A system according to claim 1, wherein:

said playback device has dimensions generally corresponding to a credit card.

3. A system according to claim 1, wherein:

said playback device is sealed within said device sleeve.

4. A system according to claim 1, wherein:

said playback device includes a speaker, and said device sleeve includes an opening coincident with said speaker.

5. A system according to claim 1, wherein:

said playback device includes recording functionality and a microphone, and said device sleeve includes an opening coincident with said microphone.

6. A system according to claim 1, wherein:

each of said transparent sleeves includes respective indicia thereon which identifies at least one of said plurality of said digital files therewith.

7. A system according to claim 1, wherein:

said at least one button of said playback device includes a plurality of playback buttons each having respective indicia associated therewith, and said plurality of transparent sleeves includes respective indicia thereon, such that said respective indicia on each one of said plurality of sleeves corresponds to said indicia associated with a respective one of the buttons.

8. A system according to claim 1, further comprising:

e) a central panel baying sides, wherein said first insert, said transparent sleeves, and said device sleeve are coupled to said sides of said central panel.

9. A system according to claim 8, further comprising:

f) a second insert sized to be received in a pocket of the wallet to couple said accessory to the wallet, wherein said first insert and said second insert are coupled to different sides of said central panel.

10. A system according to claim 9, wherein:

said panel, said first and second insert, said transparent sleeves, and said device sleeve overlie one another.

11. A system according to claim 8, wherein:

said device sleeve is coupled to said central panel with a live hinge.

12. A system according to claim 11, wherein:

said live hinge has limited movement.

13. A system according to claim 1, wherein:

said central panel is a sleeve including at least one transparent side.

14. A system according to claim 1, wherein:

said transparent sleeves are flexible.

15. A system according to claim 1, further comprising:

a plurality of photographs in said transparent sleeves, each said photograph depicting a different person.

16. A system according to claim 1, further comprising:

e) said wallet having said pocket, wherein said insert is received in said pocket.

17. An accessory system for a wallet, comprising:

a) a digital playback device having at least one memory capable of storing a plurality of digital files and at least one button adapted to initiate playback of a selected one of said files;

b) a plurality of transparent sleeves coupled to said playback device, said sleeves sized for receiving wallet-size format photographs; and c) at least one element adapted to couple said digital playback device and said transparent sleeves to the wallet.

18. A system according to claim 17, wherein:

each of said transparent sleeves includes respective indicia thereon which identifies at least one of said plurality of said digital files therewith.

19. A system according to claim 17, wherein:

said at least one button includes a plurality of buttons, and each of said buttons is provided with a distinctive indicia associated therewith, and each of said transparent sleeves includes respective indicia thereon, such that said respective indicia on each one of said plurality of transparent sleeves corresponds to said indicia associated with a respective one of the buttons.

20. A system according to claim 17, further comprising:

a device sleeve at least partially containing said playback device, said device sleeve coupled to said transparent sleeves.

21. A system according to claim 20, wherein:

said playback device includes a speaker, and said device sleeve includes an opening coincident with said speaker.

22. A system according to claim 17, wherein:

said at least one element is an insert sized to be received in a pocket of the wallet.

23. A system according to claim 17, wherein:

said at least one element is a first element oriented to be longitudinally received in a pocket of the wallet and a second element oriented to be transversely received in a pocket of the wallet.

24. A system according to claim 17, further comprising:

a central panel having side, wherein said transparent sleeves, and said at least one element are coupled to said sides of said central panel.

25. A system according to claim 24, wherein:

said central panel is a sleeve.

26. An accessory system for coupling a digital playback device to a wallet, comprising:

a) a central sleeve sized to store a wallet-size format photograph and having a plurality of sides;

b) a plurality of transparent sleeves coupled to one of said sides of said central sleeve, said transparent sleeves sized for receiving wallet-size format photographs; and c) at least one element adapted to couple the digital playback device and said transparent sleeves to the wallet.

27. An accessory system according to claim 26, wherein:

said at least element is a first element oriented to be received in a pocket of the wallet having a lateral opening and a second element oriented to be received in a pocket of the wallet having a vertical opening.

28. An accessory system for a wallet, comprising:

a) a plurality of transparent sleeves coupled together, said transparent sleeves sized for receiving wallet-size format photographs;

b) a first insert having a first end coupled to said sleeves and oriented to be received in a pocket of the wallet having a lateral opening for coupling said transparent sleeves to the wallet; and c) a second insert having a second end coupled to said sleeves and oriented to be received in a pocket of the wallet having a vertical opening for coupling said transparent sleeves to the wallet, wherein said first and second ends of said first and second inserts are offset by 90°.

29. An accessory system for a wallet, comprising:

a) a plurality of transparent sleeves sized for receiving wallet-size format photographs;

b) at least one element adapted to couple said transparent sleeves to the wallet;

c) a digital playback device having at least one memory capable of storing a plurality of digital files and a at least one button adapted to initiate playback of a selected one of said files; and d) a plurality of user-appliable indicia for said transparent sleeves, wherein when photographs are provided in said transparent sleeves and said indicia are applied to said transparent sleeves, said indicia identify each of said digital files with the photograph in said transparent sleeves.

30. An accessory system for a wallet, comprising:

a) a central panel having adjacent first and second edges angled relative to each other at approximately 90°;

b) a plurality of transparent sleeves coupled to said central panel, each of said transparent sleeves sized for receiving wallet-size format photographs;

c) a first insert coupled along its length adjacent said first edge of said central panel such that said first insert is oriented to be received in a pocket of the wallet having a lateral opening for coupling said transparent sleeves to the wallet; and d) a second insert coupled along its length adjacent said second edge of said central panel such that said second insert is oriented to be received in a pocket of the wallet having a vertical opening for coupling said transparent sleeves to the wallet.

* * * * *